United States Patent [19]

Spencer

[11] Patent Number: 4,768,793

[45] Date of Patent: Sep. 6, 1988

[54] ROLLER SKI CONSTRUCTION

[76] Inventor: David W. Spencer, SR Box 8801, Indian, Ak. 99540

[21] Appl. No.: 91,082

[22] Filed: Aug. 31, 1987

[51] Int. Cl.[4] ..... A63C 17/04

[52] U.S. Cl. ..... 280/11.1 BT; 280/11.23

[58] Field of Search ..... 280/11.1 BT, 11.1 BR, 280/11.22, 11.23, 11.25, 11.19

[56] References Cited

U.S. PATENT DOCUMENTS

| | | | |
|---|---|---|---|
| 1,975,661 | 10/1934 | Powell | 280/11.23 X |
| 2,253,012 | 8/1941 | Benner et al. | 280/11.22 |
| 3,339,936 | 9/1967 | Hamlin | 280/11.23 X |
| 3,389,922 | 6/1968 | Eastin | 280/11.23 |
| 3,722,900 | 3/1973 | Dickert | 280/7.13 |
| 3,749,413 | 7/1973 | Nicolson | 280/11.2 |
| 3,827,706 | 8/1974 | Milliman | 280/11.1 BT |
| 3,876,217 | 4/1975 | Copier | 280/11.23 |
| 3,885,804 | 5/1975 | Cudmore | 280/11.23 X |
| 3,926,449 | 12/1975 | Wilje | 280/11.23 |
| 4,021,052 | 5/1977 | Knowles | 280/11.2 |
| 4,102,541 | 7/1978 | Altorfer et al. | 280/11.1 BT |
| 4,133,546 | 1/1979 | Rosenblum | 280/11.1 BT |
| 4,134,598 | 1/1979 | Urisaka | 280/11.22 |
| 4,235,448 | 11/1980 | Thomas | 280/11.1 BT |
| 4,294,456 | 10/1981 | Tuell et al. | 280/11.23 X |
| 4,363,492 | 12/1982 | Eriksson | 280/11.1 BT |
| 4,460,187 | 7/1984 | Shimizu | 280/11.1 BT |

*Primary Examiner*—John J. Love
*Assistant Examiner*—Michael Mar
*Attorney, Agent, or Firm*—Fay, Sharpe, Beall, Fagan, Minnich & McKee

[57] ABSTRACT

A wheeled training device for simulating cross country skiing and the like on a surface which is not covered by snow includes a platform member and a support rod which is secured to the platform member and extends at each end past the platform member. A pair of longitudinally spaced wheels are provided, one being secured adjacent each end of the support rod. Each wheel is spaced from a respective adjacent end edge of the platform member. The platform member is tapered toward one side edge of the device so that the device can be tilted toward the tapered edge, to simulate a ski edging motion, without dragging on the ground.

20 Claims, 2 Drawing Sheets

ROLLER SKI CONSTRUCTION

BACKGROUND OF THE INVENTION

This invention generally pertains to exercise devices for recreational purposes. More specifically, the present invention relates to a roller ski for training long distance skiers.

The invention is particularly applicable to cross country skiing utilizing a skating technique called the "free technique." However, it will be appreciated by those skilled in the art that the invention has broader applications and may also be adapted for use in other roller ski environments or similar exercise environments as well.

A variety of sports have centered around devices which enable a person to travel rapidly across a ground surface using low friction devices mounted on his feet. Examples of such sports are ice skating, snow skiing, roller skating, and most recently, skate boarding.

Training systems for snow skiing require a device which can be used in a non-snow environment for wide and year-round application. A wheeled device is ideal for practicing on dry ground. Thus, roller skis have become well known aids for training in downhill skiing and cross country skiing when snow is not available.

Cross country skiing has been practiced in Northern countries for many hundreds of years and has recently gained popularity in the U.S. Due to the climate in this country, the cross country skiing season is generally rather short, lasting about four months. Since cross country skiing requires great stamina and good physical condition, it is advantageous for an individual who wishes to participate in this sport during the winter months to practice the basic cross country striding techniques during the off season. To accomplish the striding motion, cross country skiing utilizes a foot plate with a binding means adapted to retain the user's ski shoe in such a manner that its heel portion is freely pivotable about a firmly fixed toe portion.

Over the last two or three years, cross country skiing has split into two disciplines. The first of these is the traditional technique now called "classical" which includes the subclasses of the diagonal stride, herringbone, and double pole techniques. In a "classical" cross country ski race, a skating motion is prohibited. The classical cross country skis are waxed with a cross country wax for kick on the uphills and the traditional kick and glide stride is used. The skier stops each foot alternately, sets the wax, and pushes off. The motion is similar to running except that a glide phase is incorporated.

The second cross country skiing discipline is a new skating-like technique called the "free technique." This motion is similar to ice skating in that the skier drives off the gliding ski. The resultant track is a series of elongated V-like tracks in the snow. As the skier comes to the end of the glide phase, his ankle rolls to the inside which sets that ski on edge and provides a bite of that ski in the snow. From this, the skier is able to drive off on his other ski. At no time does the ski stop and thus no kick wax needs to be used. This results in a faster skiing technique and faster racing times.

Numerous roller skis for practicing skiing techniques are available on the market. All of these attempt to simulate the skiing stride, generally on a paved surface so that a skier is able to exercise the skiing motion during the summer months. Despite the fact that roller skis have been available for quite some period of time, the conventional roller skis have been only partially successful.

Roller skis which are designed to simulate the classical techniques of cross country skiing are generally of the three wheeled design such that two wheels are provided in the back and one in the front. A ratchet is provided on one or more of the wheels to simulate the setting action of the wax.

Roller skis for simulating the skating action of the free technique of cross country skiing are also known. Such skis are of the two wheel design with wide tires in both the front and the back so that the ski can be rolled slightly to edge and push off. However, such conventional roller skis are unable to provide a good edging action because when edging is attempted, the frame of the roller ski contacts the ground surface. Moreover, the conventional roller skis have a relatively high platform which makes the ski less stable.

Another difficulty with conventional roller skis has been the necessity of using a fork or wishbone-shaped bracket structure to support each wheel. This complicates manufacturing and increases the weight of the exercise device. Additionally, conventional roller skis do not provide tires which have been found suitable for adequately simulating the cross country skiing techniques which were attempted to be practiced.

Accordingly, it has been considered desirable to develop a new and improved roller ski which would overcome the foregoing difficulties and others while providing better and more advantageous overall results.

BRIEF SUMMARY OF THE INVENTION

In accordance with the present invention, a roller ski is provided which can preferably be used for simulating cross country skiing and the like on a surface that is not covered by snow.

More particularly in accordance with the invention, the roller ski comprises a frame means for supporting a foot of a skier and a pair of longitudinally spaced wheels as well as a support means for rotatably mounting each of the pair of wheels of the frame means. The frame means and the pair of wheels are each tapered toward one side edge of the roller ski.

In accordance with another aspect of the invention, the roller ski further comprises a binding means for attaching the roller ski to a foot of a wearer. Preferably, the binding means is secured to a top surface of the frame means and comprises a cross country ski binding.

In accordance with still another aspect of the invention, the roller ski frame means comprises a platform member having a tapered side wall and a support rod which is secured adjacent a side edge of the platform member opposite the tapered side wall.

In accordance with yet another aspect of the invention, the support means comprises an axle affixed to the support rod, and each of the wheels of the roller ski comprises a hub rotatably mounted on the axle and a tire secured on the hub. Preferably, the tire is made of a material which has a hardness of between approximately 50 and 75 on the Shore A Durometer scale and a rebound characteristic of between approximately 5 to 30%. Preferably, the tire comprises a polyurethane material.

In accordance with still yet another aspect of the invention, the roller ski tire is provided with an asymmetric profile.

In accordance with yet still another aspect of the invention, the roller ski has an aspect ratio of approximately 8:1.

According to another aspect of the invention, a method is provided for simulating the free technique of cross country skiing.

In accordance with this aspect of the invention, a roller ski, having a frame and a pair of wheels secured to the frame, wherein the frame and the pair of wheels are each tapered toward one side edge of the roller ski, is secured to each foot. Gliding is accomplished on one roller ski while elevating the other roller ski from a ground surface. The one roller ski is then tilted toward the one side edge thereof. The tapered frame and the tapered wheels prevent the roller ski from scraping the ground during the step of tilting. The other roller ski is then lowered into contact with the ground surface and the one roller ski is raised away from the ground surface. Thereafter, a gliding motion is performed on the other roller ski.

According to still another aspect of the invention, the one roller ski continues gliding even during the step of tilting.

According to yet another aspect of the invention, the one roller ski continues gliding even during the step of lowering of the other roller ski which takes place simultaneously with the step of tilting.

According to still yet another aspect of the invention, the steps of raising and gliding on the other roller ski are done simultaneously.

One advantage of the present invention is the provision of a new and improved roller ski device.

Another advantage of the invention is the provision of a roller ski having a frame and a pair of wheels which are each tapered toward one side edge of the roller ski to allow a tilting of the roller ski to take place in the direction of taper without the roller ski scraping the ground.

Still another advantage of the invention is the provision of a roller ski including a platform member and a support rod asymmetrically located on the platform member. This design allows the center of gravity of the device to be lowered without the problem of the support rod hitting the ground when the roller ski is edged.

Yet another advantage of the invention is the provision of a roller ski having a tire which is provided with an asymmetric profile.

Yet still another advantage of the invention is the provision of a roller ski tire made of a low rebound elastomer to control the rolling resistance of the tire and hence the workload required to use the roller skis.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
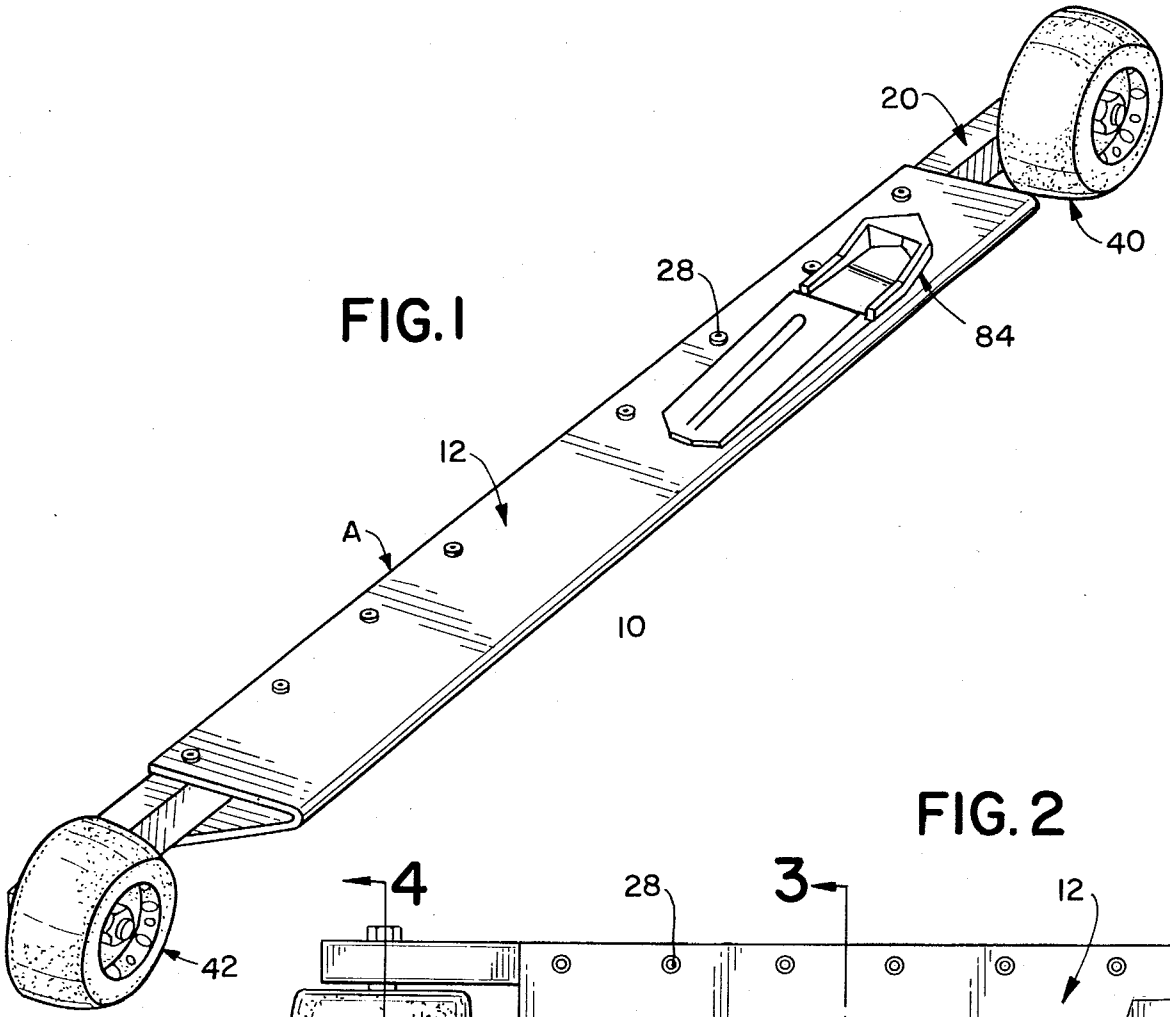
FIG. 1 is a perspective view of a roller ski according to the present invention.

Referring now to the drawings wherein the showings are for purposes of illustrating a preferred embodiment of the invention only and not for purposes of limiting same, FIG. 1 shows the subject new roller ski A. While the roller ski is primarily designed for and will be described hereinafter in connection with cross country skiing and particularly the simulation of the free technique in cross country skiing on a surface not covered by snow, it should be recognized that the roller ski could be adapted for use in other skiing and skating environments as well.

Figure 3:
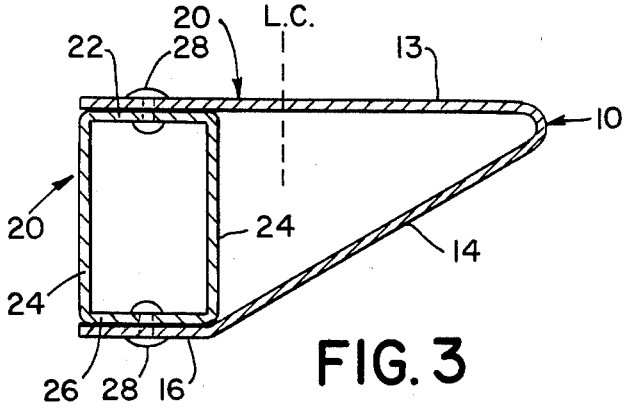
FIG. 3 is a cross-sectional view along line 3—3 of the roller ski of FIG. 2.

More particularly, the present invention relates to a roller ski A which includes a frame means 10 for supporting the foot of a skier (not illustrated). With reference now to FIG. 3, the frame means 10 comprises a binding support platform 12 having a top wall 13, a side wall 14, and a bottom wall 16. It can be seen that the side wall 14 is angled in relation to the top wall and the bottom wall so as to provide a wedge-shaped or tapered cross-sectional appearance for the platform 12. The platform can, if desired, be made from a single metal sheet which is suitably bent for this purpose. Alternatively, the platform can be made from any other suitable material in either one piece or a number of pieces which are secured together.

The frame means also comprises a support shaft or tube 20 which includes a top wall 22, a pair of side walls 24, and a bottom wall 26. As is evident from FIG. 3, the tube can have a rectangular cross-section. However it should be recognized that rods or tubes having other cross-sections could also be utilized. A plurality of suitable conventional fasteners, such as rivets 28, secures the top and bottom walls 22, 26 of the support tube 20 to the respective top and bottom walls 13, 16 of the platform 12. It is evident that the tube 20 is offset from a longitudinal centerline L.C. of the platform 12 such that the tube is to the left of the centerline whereas most of the tapered side wall 12 is to the right of the centerline.

Figure 2:
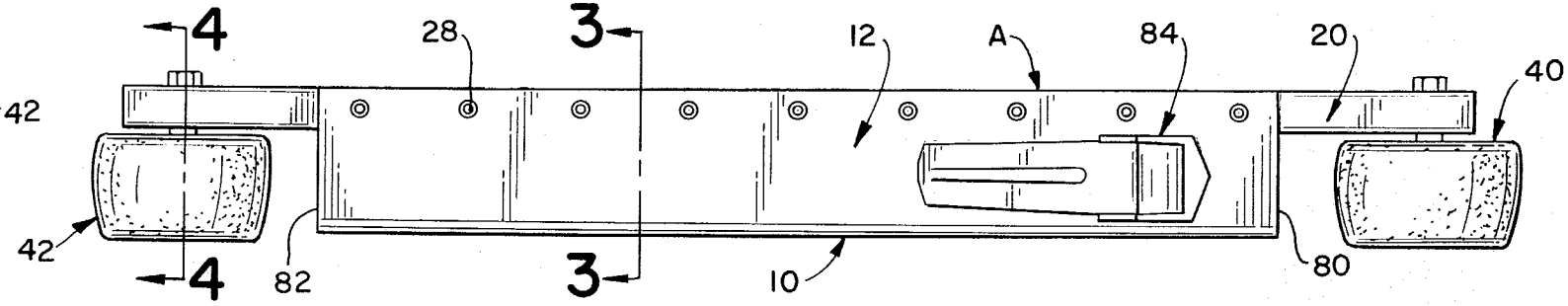
FIG. 2 is a top plan view of the roller ski of FIG. 1.

With reference now to FIG. 2, a pair of longitudinally spaced or tandem front and rear wheels 40, 42 are rotatably secured to the support tube 20. Since the two wheels are identical, only the rear wheel 42 will be discussed in detail, it being appreciated that the front wheel has the identical components.

Figure 4:
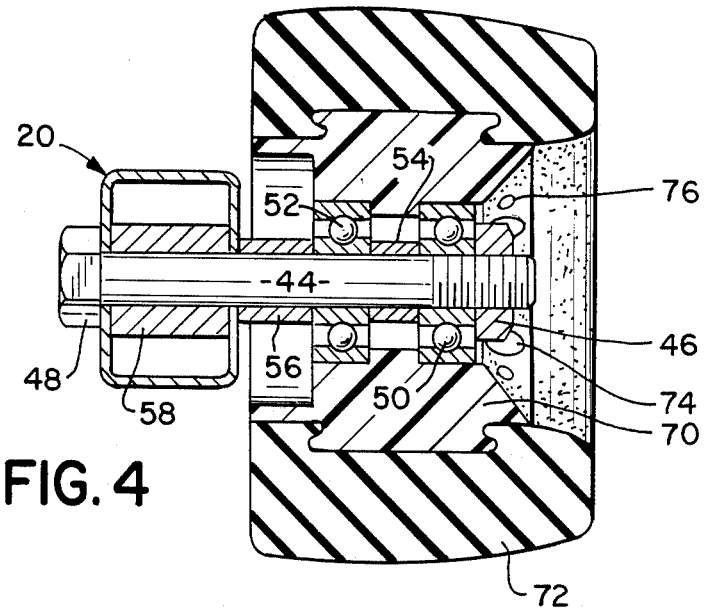
FIG. 4 is a cross-sectional view along line 4—4 of the roller ski of FIG. 2; and, FIG. 5 is an enlarged cross-sectional view of a tire profile of a tire of the roller ski of FIG. 4.

With reference now to FIG. 4, mounting the rear wheel to the support tube 20 is a support means that comprises an axle bolt 44. A suitable conventional fastener 46 and a bolt head 48 are provided on the respective ends of the axle bolt. It will be appreciated that only one end of the axle bolt 44 is secured to the support tube 20, by the bolt head 48. This allows the roller ski to be pivoted around its longitudinal centerline to its tapered side without the risk of any support structure contacting the ground.

A pair of spaced bearings 50, 52 are provided on the axle 44 separated by a spacer 54. A second spacer 56 is provided on the axle bolt 44 between the support shaft 20 and the second bearing 52. Additionally, a spacer 58 is preferably provided on the axle bolt portion which extends within the support tube 20.

Secured to the bearings 50, 52 is a hub 70 on which is mounted a preferably solid tire 72 in a suitable manner. In order to save weight, the hub can have several holes which can be of different diameter as at 74, 76 extending transversely therethrough, if desired. Preferably, the hub is made of a suitable conventional material such as a plastic while the tire is made of suitable resilient material. In one preferred embodiment, the tire is made from an elastomeric material which has a hardness of between approximately 50 and 75 on the Shore A Durometer scale and a rebound characteristic of between approximately 5 to 30%. One such suitable material is a low rebound polyurethane rubber compound.

Such a tire material is advantageous in controlling the rolling resistance of the tire and hence the workload required to use the roller ski. The tire can be made of solid material to allow for a long period of use.

With reference now again to FIG. 2, the wheels 40, 42 are spaced from the respective front and rear ends 80, 82 of the support platform 10. Provided on the top wall 13 of the platform 12 is a ski binding 84 for attaching the roller ski A to a boot (not illustrated) of a wearer. The binding is preferably a suitable conventional cross country ski binding.

The platform 12 and the wheels 40, 42 are all tapered to the right side of the roller ski as can be seen from the cross-sectional views provided in FIGS. 3 and 4 so that the roller ski can be used in an edging motion in which the roller ski A is tilted rightwards about its longitudinal centerline L.C. without scraping the ground surface. The roller ski illustrated is secured to the skier's left foot.

A mirror image roller ski (not illustrated) would be provided for the skier's right foot. This second ski would enable the skier to roll his right ankle to the left. A cross country skier would, as he comes to the end of a glide phase, roll his left ankle toward the inside, i.e. toward the right on the roller ski of FIGS. 1–5 setting the roller ski onto the tapered portions of the tires 40, 42. This simulates the setting of a normal cross country ski on its inside edge which provides bite on the snow from which the cross country skier is able to drive off with the other ski for a gliding motion in the free technique. The same action would take place with the other roller ski.

In the preferred embodiment of the invention, the tire can have a width of approximately 1.75 in. ±0.03 in. and a height of approximately 2.95 in. The platform can have a length of approximately 16 inches, a height of approximately 1.13 inches and a width across its top surface 13 of approximately 2.5 inches, and across its bottom surface 16 of approximately 0.75 inches. The length of the roller ski, from axle to axle, can be approximately 21 inches and the overall length can be approximately 24 inches. Thus the aspect ratio (length to height) can be approximately 24 to 3 or 8:1. The roller ski A has a very low center of gravity allowing it to be much more stable than previous designs which had to raise the binding platform to avoid ground contact during edging and which had a wishbone shaped axle support for their wheels.

Figure 5:
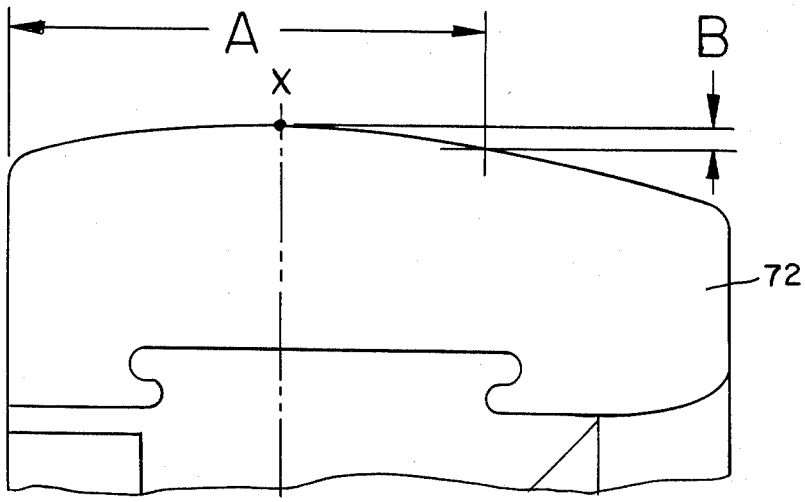

With reference now to FIG. 5, the tapering of the wheel is accomplished by the provision of a tire profile according to the preferred embodiment of the invention. A numeric profile of the tire illustrated in FIG. 5 is provided hereinbelow, wherein A is the width dimension along the tire from 0 in. to 1.750 in. and B is the height dimension along the tire from a zero point X as shown in FIG. 5.

| A | B | A | B |
|---|---|---|---|
| 0 in. | .037 in. | 875 in. | .010 in. |
| .025 | .034 | .900 | .012 |
| .050 | .031 | .925 | .014 |
| .075 | .0285 | .950 | .017 |
| .100 | .026 | .975 | .020 |
| .125 | .0235 | 1.000 | .023 |
| .150 | .021 | 1.025 | .026 |
| .175 | .019 | 1.050 | .029 |
| .200 | .017 | 1.075 | .0325 |
| .225 | .015 | 1.100 | .036 |
| .250 | .013 | 1.125 | .0395 |
| .275 | .011 | 1.150 | .043 |
| .300 | .009 | 1.175 | .047 |
| .325 | .007 | 1.200 | .051 |
| .350 | .006 | 1.225 | .055 |
| .375 | .005 | 1.250 | .059 |
| .400 | .004 | 1.275 | .0635 |
| .425 | .003 | 1.300 | 068 |
| .450 | .002 | 1.325 | .0725 |
| .475 | .001 | 1.350 | .077 |
| .500 | .0005 | 1.375 | .082 |
| .525 | .0 | 1.400 | .087 |
| .550 | .0 | 1.425 | .092 |
| .575 | .0 | 1.450 | .097 |
| .600 | .0 | 1.475 | .102 |
| .625 | .0 | 1.500 | .107 |
| .650 | .0 | 1.525 | .112 |
| .675 | .0005 | 1.550 | .117 |
| .700 | .001 | 1.575 | .122 |
| .725 | .002 | 1.600 | .128 |
| .750 | .003 | 1.625 | .134 |
| .775 | .004 | 1.650 | .141 |
| .800 | .005 | 1.675 | .149 |
| .825 | .006 | 1.700 | .157 |
| .850 | .008 | 1.725 | .166 |
| | | 1.750 | .177 |

This tire profile was experimentally determined to provide the proper lateral roll characteristics which, when coupled with the characteristics of the preferred tire material, enable a very close simulation by a roller ski of the free technique of cross country skiing. However, it should be recognized that other tire profiles may also be advantageous under certain circumstances.

The invention has been described with reference to a preferred embodiment. Obviously, alterations and modifications will occur to others upon a reading and understanding of this specification. All such modifications and alterations are intended to be included insofar as they come within the scope of the appended claims or the equivalents thereof.

What is claimed is:

1. A roller ski for use in pairs, wherein one roller ski is adapted for use only on a left foot of a skier and the other roller ski is adapted for use only on a right foot of the skier, each roller ski comprises:

a longitudinally extending frame means for supporting a foot of the skier;

a pair of longitudinally spaced wheels;

axle means extending transversely from one side of said frame means for rotatably mounting each of said pair of wheels on said frame means; and wherein said pair of wheels of a left foot ski are each tapered toward a right side edge of the roller ski and wherein said pair of wheels of a right foot ski are each tapered toward a left side edge of the roller ski, each wheel of said left foot ski and said right foot ski having a maximum diameter, wherein the diameter of each wheel decreases substantially more towards one side edge than towards the opposing side edge from the maximum diameter of the wheel.

2. The roller ski of claim 1 further comprising a binding means for attaching the roller ski to the foot of a wearer.

3. The roller ski of claim 2 wherein said binding means comprises a cross country ski binding.

4. The roller ski of claim 1 wherein said frame means comprises:

a platform member having a tapered side wall; and, a support rod secured to said platform member adjacent a side edge opposite said tapered side wall.

5. The roller ski of claim 4 wherein said support means comprises an axle affixed to said support rod, and wherein each of said wheels comprises:

a hub rotatably mounted on said axle; and, a tire secured on said hub.

6. The roller ski of claim 5 wherein said tire is made of a material which has a hardness of between approximately 50 and 75 on the Shore A Durometer scale and a rebound characteristic of between approximately 5 to 30%.

7. The roller ski of claim 5 wherein said tire comprises a polyurethane material.

8. The roller ski of claim 5 wherein said tire has an asymmetric profile.

9. The roller ski of claim 1 wherein an aspect ratio of the roller ski is approximately 8:1.

10. A wheeled training device for use in pairs, wherein one wheeled training device is adapted for use only on a left foot of a wearer and the other wheeled training device is adapted for use only on a right foot of the wearer for simulating cross country skiing and the like on a surface not covered by snow, each wheeled training device comprises:

a platform member;

a support rod which is secured to said platform member and extends longitudinally therealong, wherein said support rod extends past each end of said platform member;

a pair of longitudinally spaced wheels, a respective one being rotatably secured adjacent each end of said support rod by axle means extending transversely from one side of said support rod, wherein each wheel is spaced from a respective adjacent end edge of said platform member; and, wherein said platform member and the pair of wheels of a left foot wheeled training device are each tapered toward a right side edge of the device and wherein the platform member and the pair of wheels of a right foot wheeled training device are each tapered toward a left side edge of the device, each wheel of said left foot wheeled training device and said right foot wheeled training device having a maximum diameter, wherein the diameter of each wheel decreases substantially more towards one side edge than towards the opposing side edge from the maximum diameter of the wheel so that the device can be tilted toward said tapered edge, to simulate a ski edging motion, without contacting the surface.

11. The device of claim 10 wherein said wheels each comprise:

a hub rotatably mounted on said axle; and, a tire secured on said hub.

12. The device of claim 10 wherein said platform member has a longitudinal centerline with said platform tapered side edge being located substantially on one side of said longitudinal centerline and wherein said support rod is secured to said platform on the other side of said longitudinal centerline.

13. The device of claim 11 wherein said tire comprises an elastomeric material having a hardness of between approximately 50 and 75 on the Shore A Durometer scale and a rebound characteristic of between approximately 5 to 30%.

14. The device of claim 11 wherein said tire has an asymmetric profile.

15. The device of claim 10 wherein the aspect ratio of the device is approximately 8:1.

16. The device of claim 10 further comprising a cross country ski boot binding secured to said platform member.

17. A method for simulating the free technique of cross country skiing comprising:

securing to each foot, a roller ski having a frame and a pair of wheels longitudinally spaced secured to the frame, wherein one roller ski is adapted for use only on a left foot of a wearer and the other roller ski is adapted for use only on a right foot of the wearer wherein the frame and the pair of wheels of a left foot ski are each tapered toward a right side edge of the roller ski and wherein the frame and the pair of wheels of a right foot ski are each tapered toward a left side edge of the roller ski, each wheel of the left foot ski and the right foot ski having a maximum diameter, wherein the diameter of each wheel decreases substantialy more towards one side edge than towards the opposing side edge from the maximum diameter of the wheel;

gliding on the left foot ski while elevating the right foot ski from a ground surface;

tilting the left foot ski toward the right side edge thereof, wherein said tapered frame and wheels prevent the roller ski from scraping the ground;

lowering the right foot ski into contact with the ground surface;

raising the left foot ski away from the ground surface; and, gliding on the right foot ski.

18. The method of claim 17 wherein the left foot ski continues said step of gliding even during said step of continuous tilting.

19. The method of claim 18 wherein the left foot ski continues said step of gliding even during said step of lowering the right foot ski which takes place simultaneously with said step of tilting.

20. The method of claim 17 wherein said steps of raising the left foot ski and gliding on the right foot ski are done simultaneously.

* * * * *